United States Patent [19]

Peng

[11] Patent Number: 4,680,876

[45] Date of Patent: Jul. 21, 1987

[54] ARTICLE OF FOOTWEAR

[76] Inventor: Koh K. Peng, Jalan C. 10, Taman Melawati, Setapak, Kuala Luppur, Malaysia

[21] Appl. No.: 673,610

[22] Filed: Nov. 21, 1984

[51] Int. Cl.[4] ..... A43B 21/28; A43B 21/26; A43B 21/22

[52] U.S. Cl. ..... 36/35 B; 36/34 R; 36/35 R; 36/37

[58] Field of Search ..... 36/34 R, 35 R, 35 B, 36/37, 38, 27, 28, 29, 3 R, 3 B, 36 R

[56] References Cited

U.S. PATENT DOCUMENTS

| | | | |
|---|---|---|---|
| 1,942,312 | 1/1934 | Tutoky | 36/38 |
| 2,387,334 | 10/1945 | Lemke | 36/38 |
| 2,825,154 | 3/1958 | Windle | 36/38 |
| 2,836,907 | 6/1958 | Windle | 36/38 |
| 3,429,545 | 2/1969 | Michel | 36/38 |
| 4,129,951 | 12/1978 | Petrosky | 36/29 |
| 4,342,158 | 8/1982 | McMahon et al. | 36/35 B |
| 4,455,766 | 6/1984 | Rubens | 36/38 |

FOREIGN PATENT DOCUMENTS

| | | | |
|---|---|---|---|
| 333847 | 10/1919 | Fed. Rep. of Germany | 36/35 R |
| 2901084 | 7/1980 | Fed. Rep. of Germany | 36/29 |
| 465267 | 4/1914 | France | 36/35 R |
| 262803 | 2/1929 | Italy | 36/35 B |

*Primary Examiner*—Werner H. Schroeder
*Assistant Examiner*—Steven N. Meyers
*Attorney, Agent, or Firm*—Anthony A. O'Brien

[57] ABSTRACT

An article of footwear has a heel upper (1)(1*b*)(1*c*)(1*d*) components and lower (2) components of which are spring loaded apart to limit stop positions either by a volume of elastomeric material (5)(7)(70*b*) or by a gas spring. In accordance with the invention means (48)(48*a*)(48*b*) (48*c*)(48*d*) is provided which is adjustable to vary the rate of the spring without alteration of the limit stop position to which the components (1)(1*b*)(1*c*)(1*d*) and (2) of the heel are urged by the spring (5)(70)(70*b*).

17 Claims, 24 Drawing Figures

FIG. 4
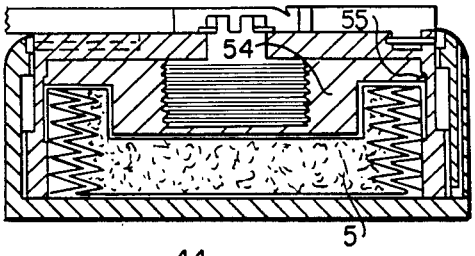
FIG. 5
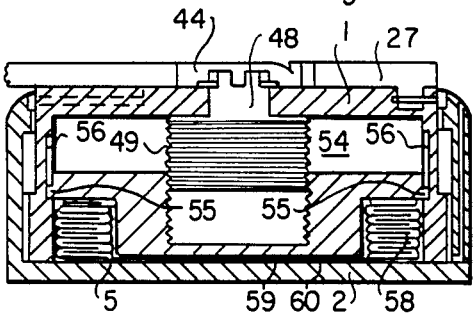
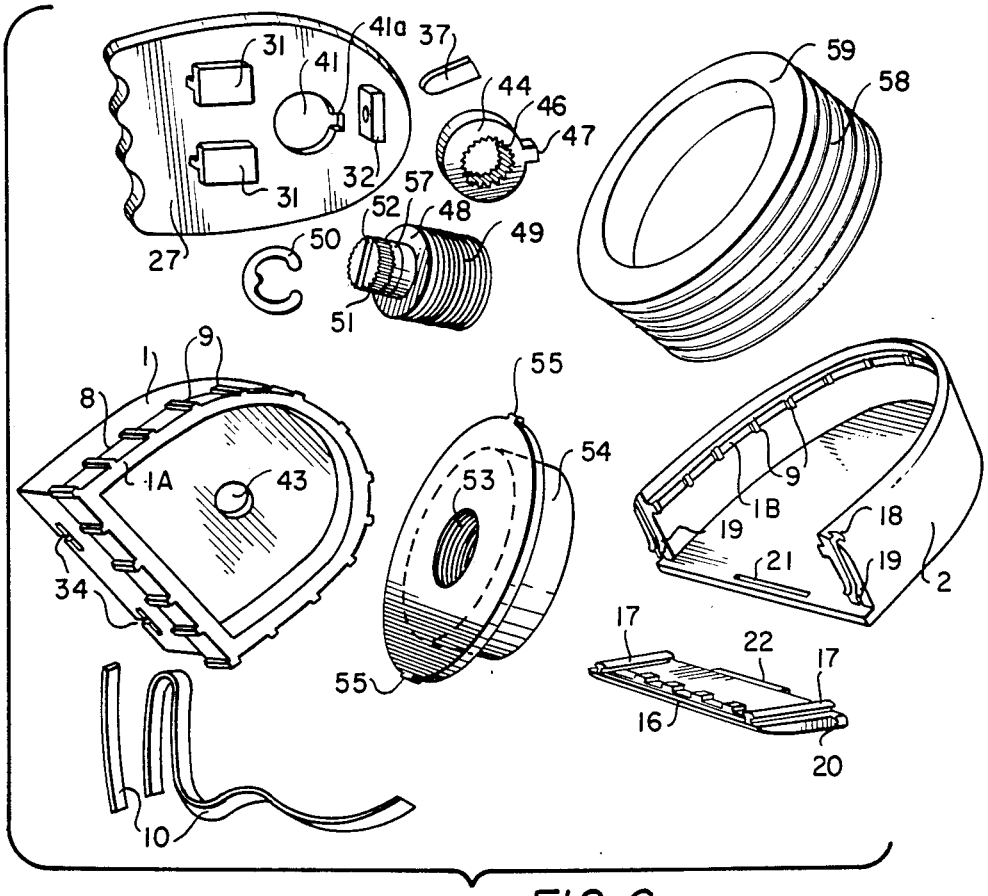
FIG. 6

ARTICLE OF FOOTWEAR

BACKGROUND OF THE INVENTION

This invention relates to an article of footwear.

The desirability of providing the ground-engaging part, more especially the heel, of an article of footwear, with a shock-absorption capacity greater than is practicably obtainable by the resilience of the material used in the construction of the article per se has been recognised for many years. To make walking on hard pavements, for example, more comfortable it has been proposed to incorporate helical metal compression springs or gas springs. For example, U.K. patent specification No. 200,368 of 1922 proposes the use of air springs in both the sole and heel regions of a boot. The problem remains, however, that comfort is determined by the relationship between the weight of the wearer, the hardness of the surface on which he is walking and the rate of the spring medium. It is a sine qua non that the spring medium should be capable of restoring the shape of the unloaded article between steps, but this can be achieved with a spring medium of such low shock-absorption as to represent very little improvement in wearer comfort. On the other hand a high shock-absorption characteristic is achieved with a relatively "hard" spring which may cause discomfort through excessive "bounce".

Prior art efforts to overcome this problem, i.e. to adapt the spring rate to the particular user, have involved (a) in the case of gas springs the introduction or exhaustion of gas (for example U.K. patent specification No. 200,368) and (b) in the case of rubber or metal springs their replacement with springs of different rate (for example U.K. patent specifications Nos. 390,368 and 427,126). Neither of these solutions is satisfactory because a source of compressed gas is not always readily available, and whereas metal springs suited to the user's weight may be selected they cannot readily be changed whenever he walks on different surfaces. These operations are in any case elaborate and expensive and not easily carried out by the wearer as occasion demands and without access to special equipment or accessories.

U.K. patent specification No. 456,979 discloses a heel sprung by a helical compression spring the rate of which can be varied by turning a screw. Here, however, the same screw determines the limit of telescopic extension of the two parts of the heel and consequently any variation of the spring rate will also affect the height of the unloaded heel and alter the extent of telescopic extension of the two heel components. U.K. patent specification No. 456,979 is not regarded by the present applicant as a practicable proposal, for example because of the manifest danger of loosening of the woodscrew, but even with improvements of a non-inventive character this specification does not disclose a sprung heel which can be readily adjusted by the wearer without affecting characteristics of the heel distinct from the rate of the spring.

SUMMARY OF THE INVENTION

A principal object of the present invention is to overcome the drawbacks of prior art proposals and fulfil this long-felt want in a simple and commercially practicable manner.

In accordance with the present invention there is provided an article of footwear comprising upper and lower components capable of limited movement toward and away from one another, a spring medium between said components and a member adjustably movable with respect to one of said components to very the rate of the spring without alteration of the limit stop positions to which the unloaded components are urged by the spring medium.

In preferred constructions the components have peripheral walls one of which telescopically receives the other, said walls defining an enclosure for the spring medium and having respective, oppositely-directed abutments which come into contact to prevent separation of the components.

A collapsible member between said components may define an enclosure for the spring medium, and the collapsible member may be reinforced by a wall extending from one of said components toward the other adjacent the collapsible member, said wall serving also to limit the approach of said components.

The collapsible member may be of concertina configuration, and radially innermost and radially outermost portions of the member may be thickened or otherwise reinforced to provide annular bead formations which become stacked when the member is collapsed, thereby limiting the approach of said components.

In embodiments in which the enclosure is defined by a collapsible member the components may be additionally interconnected by a telescopic link articulated to one of the components and adapted to prevent relative lateral movement of said components except accompanied by relative angular movement about the point of articulation.

The adjustable member preferably comprises a head portion which is rotatable but non-axially displaceable relative to said one component, the head portion being engageable on the side of said one component remote from the other for rotating the same and being integral on the other side of said one component with a screw-threaded shank portion in engagement with a screw-threaded bore in a compression element, the arrangement being such that rotation of the shank causes axial displacement relative thereto of the compression element which in turn varies the rate of the spring medium.

The head preferably has a formation for engagement by a tool to rotate the same and a peripheral formation for keying engagement with a plug which covers the head in use of the article and is non-rotatable relative to said one component but which plug is disengageable from said head to permit access thereto by said tool.

Said spring medium may be a gas spring in an enclosure between said components and the adjustable member may be adjustably movable relative to one of the components into or out of the enclosure, thereby to vary the volume of the enclosure and hence the rate of the gas spring.

Alternatively, said spring medium may be a body of elastomeric material, in which case the compression element preferably spans the area within the, or the innermost, wall and is in sliding contact therewith.

In embodiments in which a gas spring is used, the enclosure of the gas spring may be defined by an annular collapsible element which extends between the compression element and the other of said components, the compression element having a peripheral recess into which the collapsible element will be received if the compression element is forced into contact with said other component.

Alternatively, the cross-sectional area of the compression element may be less than that of the enclosure and a, or a second, collapsible element may extend in gas-tight manner between said one component and the periphery of the compression element.

Where a link is used, separation of said components may be limited by the abutment of an enlargement of one part of the link with a shoulder in a bore of another part of the link, said other part of the link being constituted by said screw-threaded shank portion. Said components may be the upper and lower components of a hollow heel structure.

BRIEF DESCRIPTION OF THE DRAWINGS

Preferred embodiments of the invention will now be described with reference to the accompanying drawings, in which:

FIGS. 4 and 5 are views similar to FIG. 1 with the heel in different states of compression, FIG. 6 is an exploded view illustrating the different components of the heel of FIGS. 1–5, FIGS. 7 and 8 are sectional elevations of a second embodiment of a hollow heel in accordance with the invention, taken respectively on the lines I—I and J—J of FIG. 9.

DETAILED DESCRIPTION OF THE INVENTION

Figure 1:
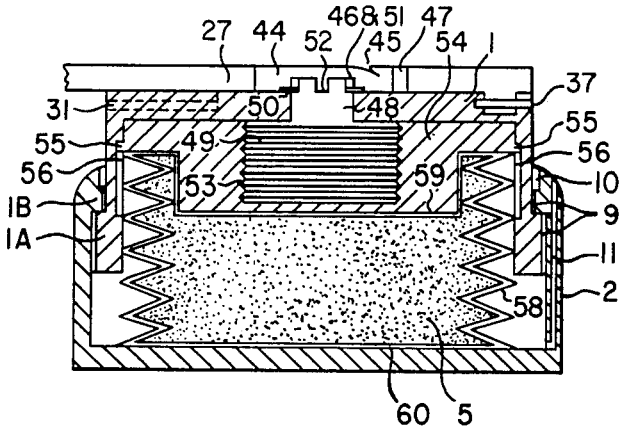
FIGS. 1 and 2 are sectional elevations of a hollow heel structure taken respectively on the lines G—G and H—H of FIG. 3.
Figure 2:
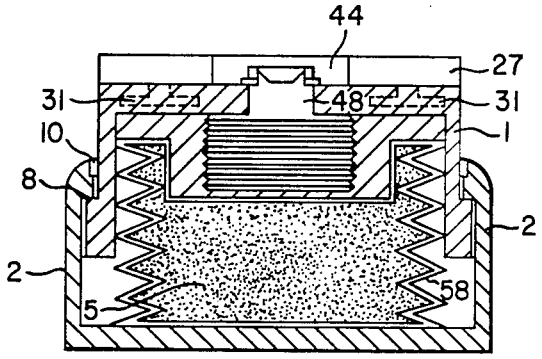
Figure 3:
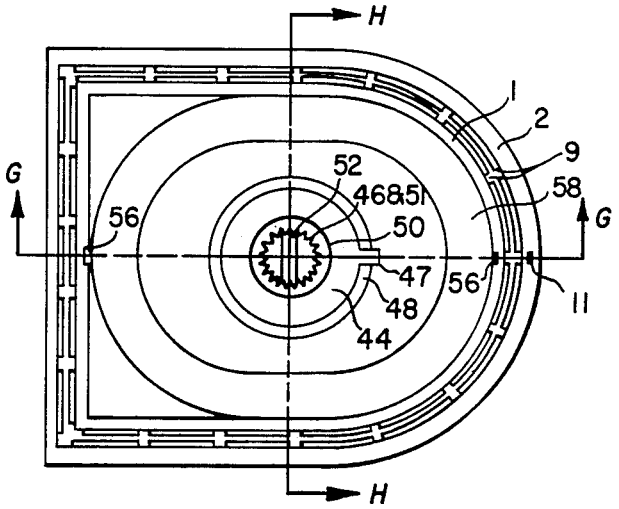
FIG. 3 is a plan view of the heel of FIGS. 1 and 2 with upper parts removed.
Figure 7:
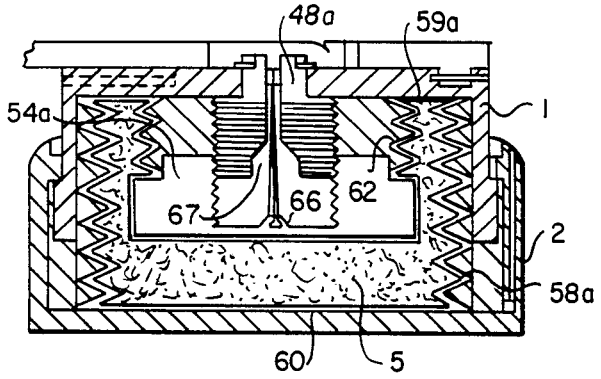
Figure 8:
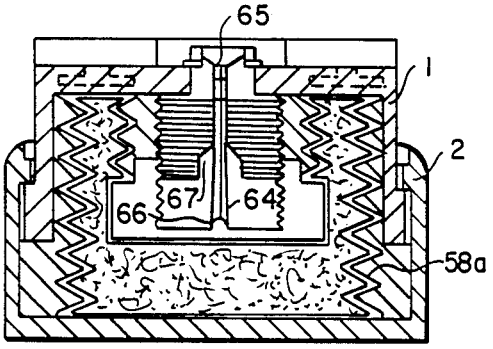
Figure 9:
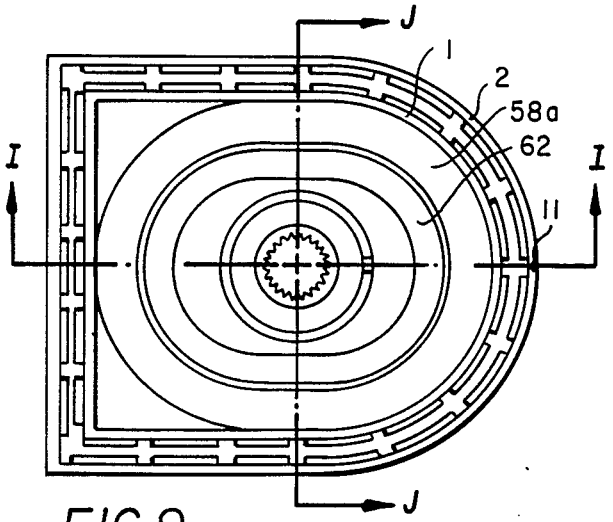
FIG. 9 is a plan view with upper parts removed of the heel of FIGS. 7 and 8, FIGS. 10 and 11 illustrate the heel of FIGS. 7–9 in different states of compression.

The hollow heel for a boot or shoe illustrated in FIGS. 1–6 comprises upper and lower components 1 and 2 which are relatively telescopic but the extension of each of which relative to the other is limited by limit stop means comprising flanges 1A and 1B defining limit stop positions between which said components are capable of limited movement toward and away from one another as shown in FIG. 1. The upper component 1 of the heel is connected to the underside of the rear portion of the sole 27 of the associated article of footwear by T-flanges 31 on the sole 27 which locate in T-slots 34 in the heel component 1 and by an apertured lug 32 on the sole 27 which locates in a recess in the upper surface of the component 1 and is held therein by a pin 37.

In a central position the rear portion of the sole 27 is formed with a hole 41 in which a plug 44 can be seated. The plug 44 has a radial lug 47 which engages in a radial extension 41A of the hole 41 when the plug is seated in the hole, to prevent rotation of the plug 44 in the hole 41 for a reason to be later explained, and the plug is formed with a slit 45 in which any suitable instrument, such as a screwdriver or penknife, can be inserted when it is desired to remove the plug 44 from the hole 41.

The heel illustrated is a spring heel to which resilience is imparted by a gas spring. The gas spring is constituted by a mass of gas (such as air) trapped in a sealed enclosure 5 within the hollow heel, the enclosure being formed by a collapsible tubular concertina-like membrane 58 sealed at its opposite ends by a disc 60 fixed to the lower heel component 2, and by a disc 59 fixed to a compression element 54.

The compression element 54 has a central, internally screw-threaded blind bore 53 and has peripheral lugs 55 which, by engaging in grooves 56 in the inner periphery of the wall of the upper heel component 1, prevent rotation of the element 54 while permitting it to move in the up-and-down direction. Such up-and-down movement is controlled by the external screw-threads of a shank of a rotatable member 49, which has a reduced-diameter head portion 48 held against axial displacement in a hole 43 in the upper heel component 1 by a circlip 50. The circlip 50 engages in a peripheral groove 57 in the head 48 below peripheral splines 51 of the head which, when the plug 44 is positioned as in FIGS. 1 and 2, engage the teeth 46 so that the plug prevents rotation of the rotary part 48,53 of the compression member 48,53,54. The free end of the head 48 is formed with a slot 52 which can be engaged by a suitable tool such as a screwdriver, or even a coin, when it is desired to adjust the compression member 48,53,54 after removing the plug 44.

To reduce friction the upper component 1 and the lower component 2 of the hollow heel each have ribs 9 contacted by the other component. A sealing ribbon 10 is located between the parts in a recess in component 2 but to allow the entry and expulsion of air between components 1 and 2 outside the enclosure 5 a channel 11 is provided in the wall of component 2.

In use of the heel 1, 2 illustrated the rate of the gas spring 5 can be adjusted at any time by the wearer, without simultaneously varying the overall height of the unloaded heel (FIGS. 1 and 2) by removing the plug 44 from the hole 41 in the sole 27, rotating the rotatable part 48,49 of the compression member by means of a tool inserted in the slot 52 and then repositioning the plug 44 to hold the rotatable part 48,49 in its new position. Rotation of the part 48,49 in one sense will drive the part 54 downward, thereby placing gas (such as air) in the enclosure 5 under greater initial pressure while its rotation in the other sense will relieve the pressure of the gas spring 5.

As shown in FIG. 4, telescopic contraction of the heel under abnormal forces is limited by abutment of the free end of the wall of component 1 with the bottom of component 2. In the exceptional circumstances that the pressure in gas spring 5 has been increased by moving the element 54 down so far that, when the heel "bottoms out" under an exceptional load, the element 54 will contact the floor of heel part 2 at the same time as, or even before, the wall of component 1 the fully collapsed membrane 58 will, as shown in FIG. 5, be received into an annular peripheral recess of the element 54.

The exploded view of FIG. 6 shows how the heel assembly of FIGS. 1–5 can be put together. The heel component 1 with the compression member 48,49,54 mounted therein is inserted in the heel component 2 by passing the ribbed flange 1A under the ribbed flange 1B. At the same time the gas spring 5 is positioned in heel component 2, after which the front of heel component 2 is closed off by inserting T-formations 17 on opposite sides of a front wall 16 in T-grooves 18 at opposite extremities of the wall of part 2. A flange 22 enters a slot 21 and notches 20 snap over protrusions 19. T-formations 31 of the sole 27 are now slid into T-slots 34 in component 1, lug 32 is pressed into its recess in component 1 until locking pin 37 can be inserted and finally the plug 44 is positioned in hole 41 to engage the splines on head 48.

The embodiment of FIGS. 7–12 resembles that of FIGS. 1–6 and like parts have like references. In this case, however, the axially movable compression element 54A does not act on the collapsible element 58A but instead is of lesser diameter than the element 58A which extends into contact with the underside of the top of heel component 1. However, the compression element 54A is connected to a second, inner collapsible element 62 extending between element 54A and the underside of the top of component 1. The effect of axially displacing the element 54A by rotating the element 48A is thus not to compress the element 58A but to vary the volume of the gas spring 5 and therefore the pressure prevailing therein, assuming that the mass of the gas is constant. To prevent the element 54A being screwed fully off the element 48A a cord 64 passes through an eye 66 in part 54A and emerges from a bore in part 48A to be engaged by a clip 65.

Figure 10:
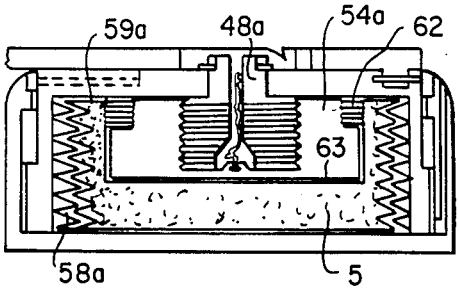
Figure 11:
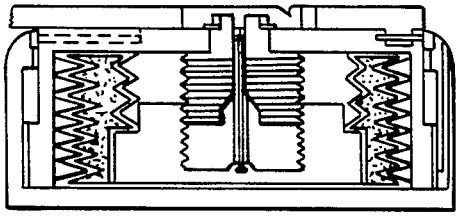
Figure 12:
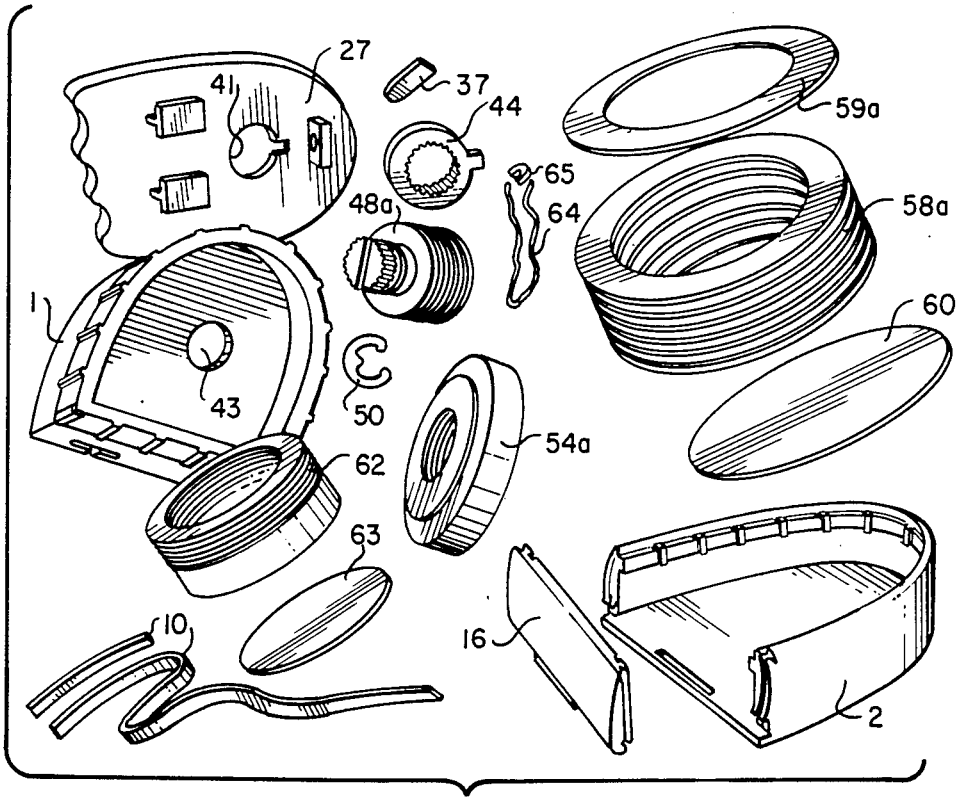
FIG. 12 is an exploded view of the heel of FIGS. 7–11, showing the different elements of its construction.

The collapsible element 58 of FIGS. 1–6, or each collapsible element 58A and 62 of FIGS. 7–12 may be of bellows-like configuration and may be made of metal. They may be manufactured in the following way. An originally cylindrical metal tube may be first subjected to lateral forces to give it a bellows-like configuration and then subjected to longitudinal forces to give it the desired length. As shown in FIG. 12 two tubes 58A and 62 of different length and diameter are then assembled, as by welding, with discs 60 and 63 which close one of their respective ends and a washer 59A which bridges the other end of the larger tube 58A and the other end of the smaller tube 62 defining the gas-tight enclosure 5.

In use gas, such as air, is introduced at suitable pressure into the enclosure 5 before it is sealed. When the wearer of the article of footwear wishes to alter the resilient characteristics of the heel he first removes the plug 44, e.g. by insertion of a penknife or screwdriver in the slit 45 and then by engaging the recess 52 with a suitable tool, such as a screwdriver, he rotates the member 48A so that the bellows 62 is extended, as shown in FIG. 11 or contracted, as shown in FIG. 10. The effect of extending the bellows 62 is to "harden" the resilient heel, because the volume of the enclosure 5 is reduced, while the effect of contracting the bellows 62 is to "soften" the resilient heel because the volume of the enclosure 5 is effectively increased, the mass of the gas in the enclosure 5 in both cases remaining constant. Having adjusted the heel to his satisfaction the wearer simply replaces the plug 44 in the hole 41, whereupon the teeth 46 engage the splines of the head 48 to prevent any unintended rotation and consequently any unintended alteration of the rate of the gas spring 5.

The embodiment of the invention illustrated in FIGS. 13–16 differs from the previous embodiments in that the gas spring 5 is replaced by a spring in the form of a body 70 of resilient material, such as foam rubber (natural or synthetic) and the rate of the spring is varied by varying the amount of compression applied to the body 70 by a compression element 54B. In other respects, however, this embodiment of a hollow heel resembles those of FIGS. 1–6 and 7–12 and like parts have like reference numerals.

In the embodiment of FIGS. 13–16 the body 70 of foam rubber is encapsulated in a rigid lining member 72 which serves to prevent extrusion of the foam rubber outwardly of the wall of component 1 of the heel and which receives the compression element 54B as a tight sliding fit. The compression element 54B is reinforced on its upper surface by flanges 69 to prevent distortion under load. To prevent the compression element 54B becoming detached from the rotary element 49 the screw-thread of the latter terminates at 68.

Figure 13:
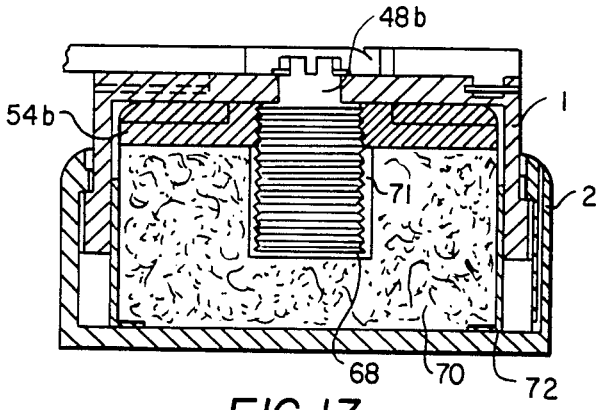
FIGS. 13, 14 and 15 are similar side sectional elevations of a third embodiment of hollow heel in accordance with the invention showing the elastomeric spring in different states of compression.
Figure 14:
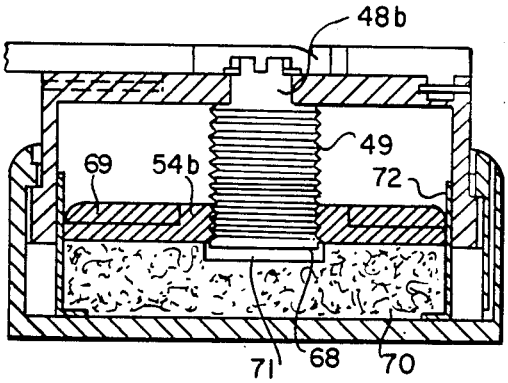
Figure 15:
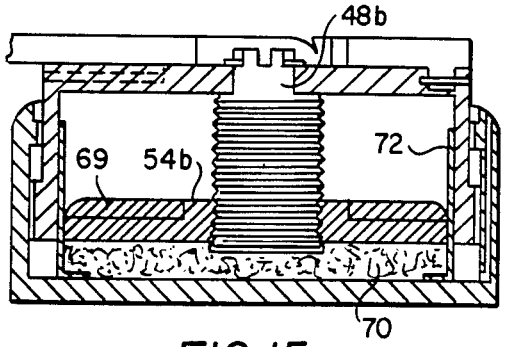
Figure 16:
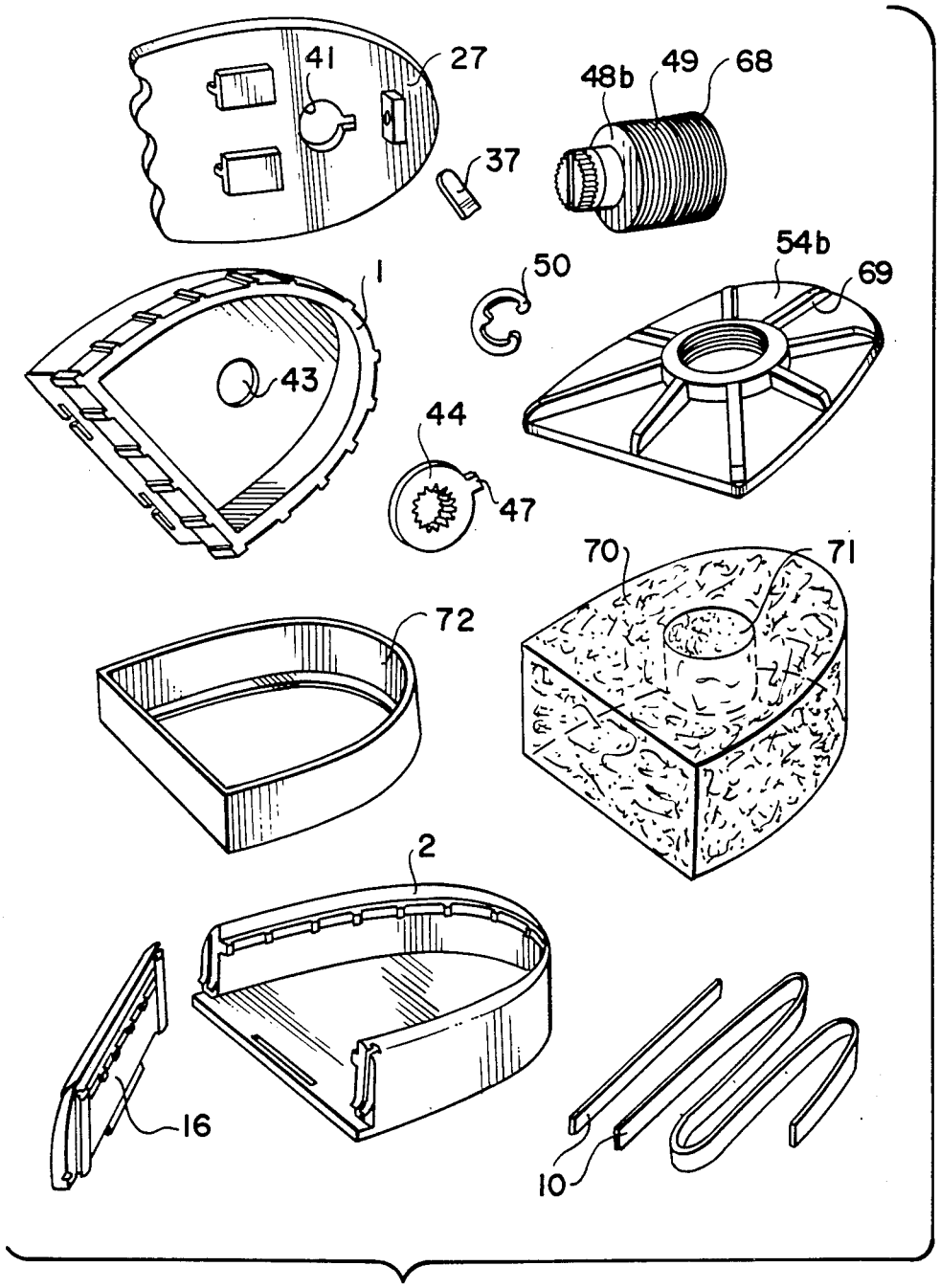
FIG. 16 is an exploded view of the heel of FIGS. 13–15, showing the elements of its construction.

FIG. 13 shows the compression element 54B in its highest possible position within the hollow heel, so that the spring 70 is as "soft" as possible. In FIG. 14 the spring 70 has been "hardened" as much as possible by displacing the compression element 54B as far as possible down the rotary element 48B. FIG. 15 illustrates what happens when the heel, "hardened" as in FIG. 14, is subjected to an exceptional load. In these conditions the body 70 is fully compressed but will return the components 1 and 2 of the heel to the position of FIG. 14 when the heel is relieved of load.

Figure 17:
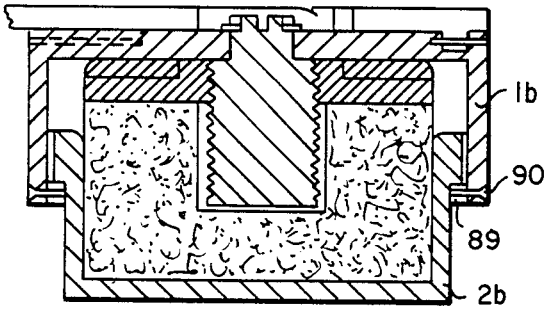
FIGS. 17 and 18 illustrate optional variants of the embodiment of FIGS. 13–16.
Figure 18:
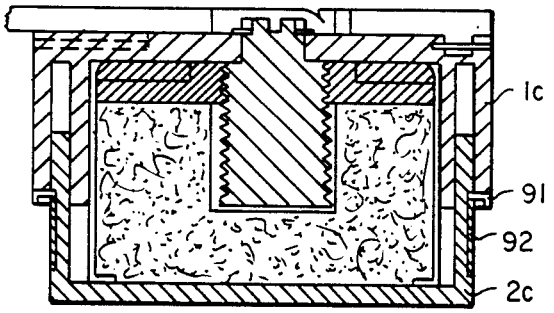

FIGS. 17 and 18 illustrate optional variants of the embodiment of FIGS. 13–16. In FIG. 17 the lining member 72 can be dispensed with because the lower heel component 2B is telescopically received in the upper heel component 1B, instead of vice versa. The outwardly-directed, ribbed flange at the upper end of the wall of component 2B is entrapped by an inwardly directed flange 89 fixed by screws to the lower end of the wall of component 1B. In FIG. 18 the wall of the lower component 2C is telescopically received in an annular slot in the wall of the upper heel component 1C. Relative telescopic movement of the components 1C and 2C is limited by pins 91 which extend inward of the slot from the wall of component 1C and are engaged in respective channels 92 in the wall of component 2C.

Figure 19:
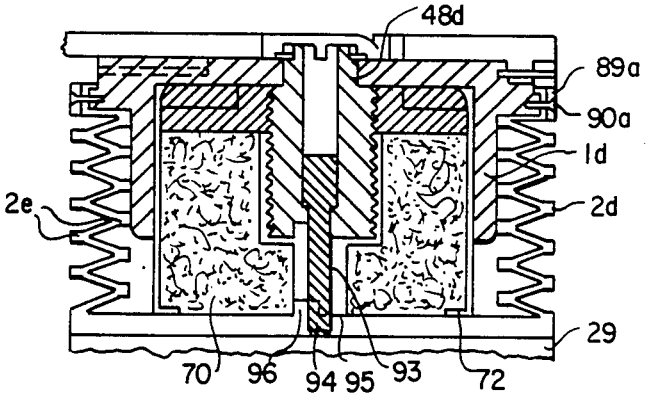
FIG. 19 is a side sectional elevation of a third embodiment of a hollow heel in accordance with the invention.
Figure 20:
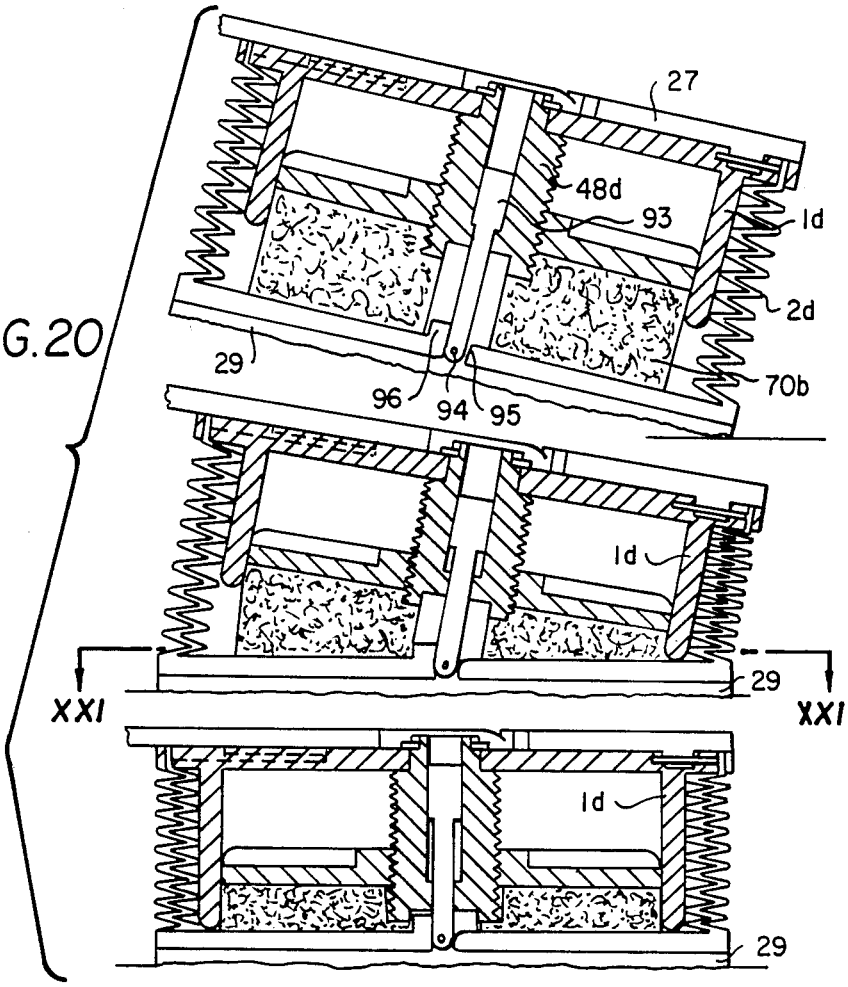
FIG. 20 illustrates in side sectional elevation a fourth embodiment of a hollow heel in accordance with the invention in three angular attitudes.
Figure 21:
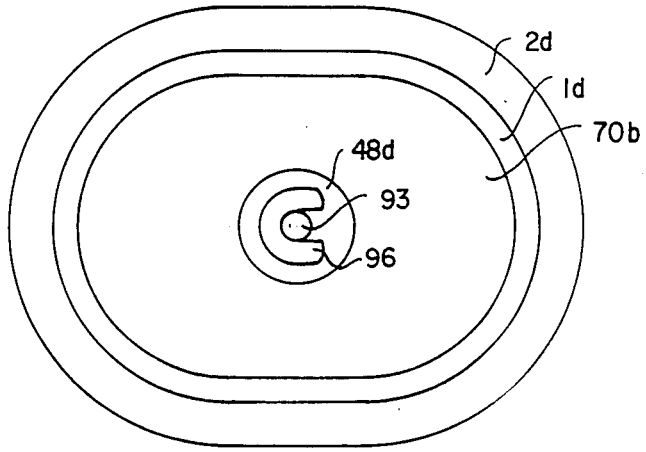
FIG. 21 is a sectional plan view taken on the line XXI—XXI of FIG. 20, and FIGS. 22–24 illustrate a fifth embodiment of a hollow heel in accordance with the invention, FIG. 22 being a perspective view showing outer parts of the heel in phantom lines, FIG. 23 being a side sectional elevation and FIG. 24 being an exploded view showing the individual elements of the construction.

The embodiments of FIGS. 19 and 20,21 differ from the remaining embodiments by the absence of mutually telescopic, rigid walls on the upper and lower component of the hollow heel. In these embodiments a rigid wall 1D depends from the upper wall component but this serves primarily to limit downward movement of the upper component relative to the lower component, as well as helping to prevent distortion of the collapsible wall 2D of the lower heel component. In FIG. 19 both the radially innermost and the radially outermost portions of the bellows-like collapsible element 2D are thickened as at 2E. These thickenings both reinforce the structure of the collapsible element 2D and adopt a stacked formation if the element 2D is fully compressed, in effect providing solid inner and outer annuli which protect from distortion the thinner, web portions of the element 2D which connect them.

In place of the co-operating flanges 1A,1B of previous embodiments movement away from one another of the ground-engaging part 29 of the lower component 2D of the heel and its upper component 1D is limited by a telescopic link 93 having an enlarged head reciprocable in a bore in the rotatable element 48D. This bore is of reduced diameter at its lower end to provide an annular shoulder which the enlarged head of the link 93 will abut when the heel is of maximum permitted height. An advantage of the embodiments of FIGS. 19,20 and 21 over those previously described is that angular movement between the upper and lower heel components 1D and 29 is permissible except under conditions of maximum load as exemplified by the lowest of the three views of FIG. 20. The link 93 and co-operating bore in the part 48D prevent relative lateral movement of the upper and lower components of the heel except accompanied by relative angular movement about the point 94 of articulation of the link 93 to the lower heel component 2D. The extent of permitted angular deflection in a given direction can be controlled by the shape of a recess 95 in which the lower end of the link 93 is seated, and angular deflection in a given direction can be prevented altogether by an upright stop 96. In a preferred construction relative angular movement between the upper and lower components of the heel is permitted in one direction only, the stop 96 being of rearwardly-opening horseshoe shape as shown in FIG. 21. By this arrangement, as illustrated by the successive views of FIG. 20, maximum shock-absorption is provided when, in walking, the rear of the heel first strikes the ground, by the permitted angular deflection of the two components of the heel. This advantage is obtained, however, without instability of the heel to forces applied laterally or forwardly.

Figure 22:
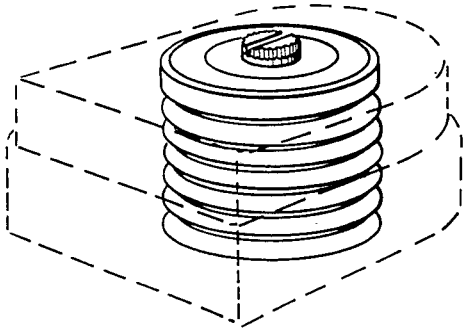
Figure 23:
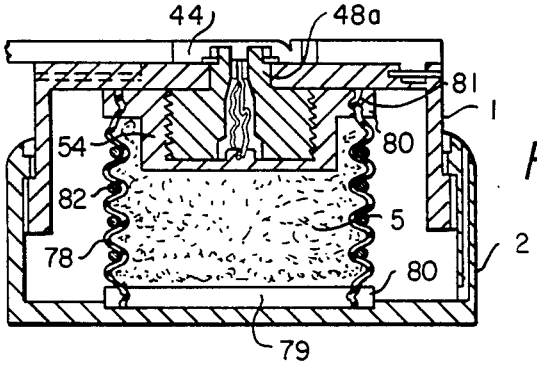
Figure 24:
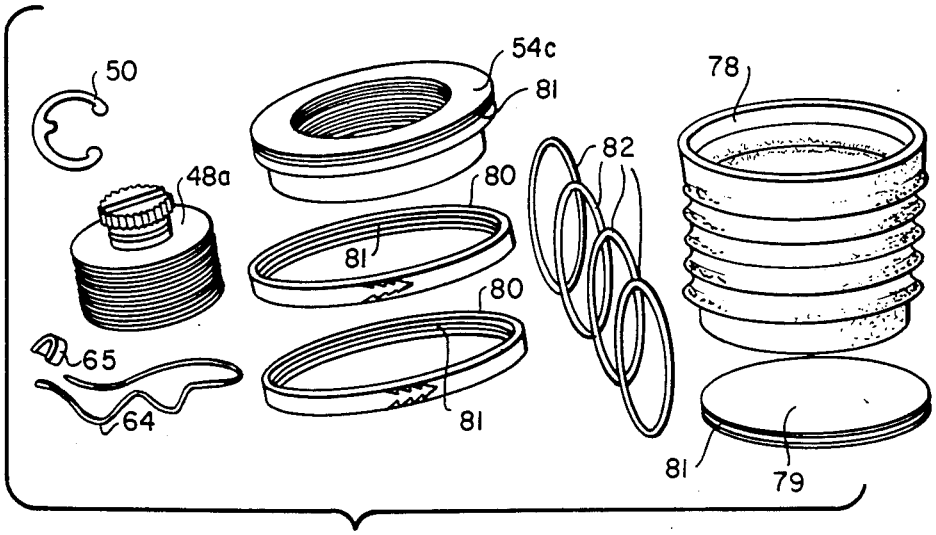

The embodiment of the invention illustrated in FIGS. 22–24 resembles those of FIGS. 1–6 and 7–12, like parts having like reference numerals, but in this embodiment the gas spring 5 is constituted by a tubular membrane 78 which is sealed in a gas-tight manner to the periphery of the compression element 54 at one end and to the periphery of a disc 79 at its other end. Both of these peripheries have grooves 81 in which the respective end of the membrane 78 is clamped by a ring 80. Additional rings 82 occupy corrugations along the length of the membrane 78 to reinforce it. As in the embodiment of FIGS. 7–12 a cord 64 passed through a loop in the compression element 54 and held by a U-shaped member 65 seated in the head 48A prevents total separation between the rotary part 48A and the axially-movable part 54 of the compression component.

I claim:

1. An article of footwear comprising a ground-engaging part comprising upper and lower components, limit stop means associated with said components to define limit stop positions between which said components are capable of limited movement toward and away from one another, a spring medium between said components, a compression element movable relative to one of said components independently of the limit stop means, an adjustable member which is rotatable but not axially displaceable relative to said one component and means operatively connecting the adjustable member and the compression element whereby rotation of the adjustable member displaces the compression element toward or away from said one component thereby to vary the rate of the spring medium without altering said limit stop positions between which the components are relatively movable by, or against the action of, the spring medium.

2. An article as claimed in claim 1, wherein the components have peripheral walls one of which telescopically receives the other, said walls defining an enclosure for the spring medium and having said limit stop means comprise respective, oppositely-directed flanges which come into contact to prevent separation of the components.

3. An article as claimed in claim 1, wherein a collapsible member between said components defines an enclosure for the spring medium.

4. An article as claimed in claim 3, wherein the collapsible member is reinforced by a wall extending from one of said components toward the other adjacent the collapsible member, said wall serving also to limit the approach of said components.

5. An article as claimed in claim 3, wherein the collapsible member is of concertina configuration.

6. An article as claimed in claim 5, wherein radially innermost and radially outermost portions of the collapsible member are thickened or otherwise reinforced to provide annular head formations which become stacked when the member is collapsed, thereby limiting the approach of said components.

7. An article as claimed in claim 6, wherein the adjustable member comprises a head portion which is rotatable but non-axially displaceable relative to said one component, the head portion being engageable on the side of said one component remote from the other for rotating the same and being integral on the other side of said one component with a screw-threaded shank portion in engagement with a screw-threaded bore in a compression element, the arrangement being such that rotation of the shank causes axial displacement relative thereto of the compression element which in turn varies the rate of the spring medium.

8. An article as claimed in claim 7, wherein the head portion has a formation for engagement by a tool to rotate the same and a peripheral formation for keying engagement with a plug which covers the head portion in use of the article and is non-rotatable relative to said one component but which plug is disengageable from said head portion to permit access thereto by said tool.

9. An article as claimed in claim 8, wherein said spring medium is a body of elastomeric material.

10. An article as claimed in claim 8, wherein said spring medium is a gas spring in an enclosure between said components and wherein the adjustable member is adjustably movable relative to one of the components into or out of the enclosure, thereby to vary the volume of the enclosure and hence the rate of the gas spring.

11. An article as claimed in claim 10 wherein the compression element spans the area within the, or the innermost, wall and is in sliding contact therewith.

12. An article as claimed in claim 11, wherein the enclosure of the gas spring is defined by an annular collapsible element which extends between the compression element and the other of said components, the compression element having a peripheral recess into which the collapsible element will be received if the compression element is forced into contact with said other component.

13. An article as claimed in claim 1, wherein said components are upper and lower components of a hollow heel structure.

14. An article of footwear comprising a ground-engaging part comprising upper and lower components, limit stop means associated with said components to define limit stop positions between which said components are capable of limited movement toward and away from one another, a spring medium between said components, a compression element movable relative to one of said components independently of the limit stop means, an adjustable member which is rotatable but not axially displaceable relative to said one component, a screw-threaded interconnection operatively connecting the adjustable member and the compression element and means for preventing rotation of the compression element with the adjustable member whereby rotation of the adjustable member displaces the compression element toward or away from said one component thereby to vary the rate of the spring medium without altering said limit stop positions between which the components are relatively movable by, or against the action of, the spring medium.

15. An article of footwear comprising upper and lower components, limit stop means associated with said components to define limit stop positions between which said components are capable of limited movement toward and away from one another, a spring medium between said components and a member adjustably movable with respect to one of said components independently of the limit stop means to vary the rate of the spring without alteration of the limit stop position to which the unloaded components are urged by the spring medium, a collapsible member of concertina configuration between said components defining an enclosure for the spring medium, radially innermost and radially outermost portions of the collapsible member being thickened or otherwise reinforced to provide annular bead formations which become stacked when the member is collapsed, thereby limiting the approach of said components and a telescopic link additionally interconnecting said components, the link being articulated to one of the components and being adapted to prevent relative lateral movement of said components except accompanied by relative angular movement about the point of articulation.

16. An article of footwear comprising upper and lower components, limit stop means associated with said components to define limit stop positions between which said components are capable of limited movement toward and away from one another, a spring medium between said components and a member adjustably movable with respect to one of said components independently of the limit stop means to vary the rate of the spring without alteration of the limit stop position to which the unloaded components are urged by the spring medium, a collapsible member of concertina configuration between said components and defining an enclosure for the spring medium, radially innermost and radially outermost portions of the collapsible member being thickened or otherwise reinforced to provide annular bead formations which become stacked when the member is collapsed, thereby limiting the approach of the components, the adjustable member comprising a head portion which is rotatable but non-axially displaceable relative to said one component, the head portion being engageable on the side of said one component remote from the other for rotating the same and being integral on the other side of said one component with a screw-threaded shank portion in engagement with a screw-threaded bore in a compression element, the arrangement being such that rotation of the shank causes axial displacement relative thereto of the compression element which in turn varies the rate of the spring medium, the head having a formation for engagement by a tool to rotate the same and a peripheral formation for keying engagement with a plug which covers the head in use of the article and is non-rotatable relative to said one component but which plug is disengageable from said head to permit access thereto by said tool, the spring medium being a gas spring in an enclosure between said components and the adjustable member being adjustable movable relative to one of the components into or out of the enclosure, thereby to vary the volume of the enclosure and hence the rate of the gas spring, the cross-sectional area of the compression element being less than that of the enclosure and a second collapsible element extending in gas-tight manner between said one component and the periphery of the compression element.

17. An article of footwear comprising upper and lower components, limit stop means associated with said components to define limit stop positions between which said components are capable of limited movement toward and away from one another, a spring medium between said components and a member adjustably movable with respect to one of said components independently of the limit stop means to vary the rate of the spring without alteration of the limit stop position to which the unloaded components are urged by the spring medium, the adjustable member comprising a head portion which is rotatable but nonaxially displaceable relative to said one component, the head portion being engageable on the side of said one component remote from the other for rotating the same and being integral on the other side of said one component with a screw-threaded shank portion in engagement with a screw-threaded bore in a compression element, the arrangement being such that rotation of the shank causes axial displacement relative thereto of the compression element which in turn varies the rate of the spring medium, a collapsible member of concertina configuration between said components and defining an enclosure for the spring medium, radially innermost and radially outermost portions of the collapsible member being thickened or otherwise reinforced to provide annular bead formations which become stacked when the member is collapsed, thereby limiting the approach of the components, the components being additionally interconnected by a telescopic link articulated to one of the components and adapted to prevent relative lateral movement of said components except accompanied by relative angular movement about the point of articulation, the spring medium being a gas spring in an enclosure between said components, the adjustable member being adjustably movable relative to one of the components into or out of the enclosure, whereby to vary the volume of the enclosure and hence the rate of the gas spring, separation of the said components being limited by the abutment of an enlargement of one part of the link with a shoulder in a bore of another part of the link, said other part of the link being constituted by said screw-threaded shank portion.

* * * * *